US010806235B1

(12) United States Patent
Bernstein et al.

(10) Patent No.: US 10,806,235 B1
(45) Date of Patent: Oct. 20, 2020

(54) FRAMELESS ADJUSTABLE FACIAL AND COSMETIC/MAKEUP SHIELD

(71) Applicants: Kenneth Scott Bernstein, Aurora, CO (US); Sheridan Elle Bernstein, Aurora, CO (US)

(72) Inventors: Kenneth Scott Bernstein, Aurora, CO (US); Sheridan Elle Bernstein, Aurora, CO (US)

( * ) Notice: Subject to any disclaimer, the term of this patent is extended or adjusted under 35 U.S.C. 154(b) by 283 days.

(21) Appl. No.: 15/920,245

(22) Filed: Mar. 13, 2018

Related U.S. Application Data

(60) Provisional application No. 62/474,966, filed on Mar. 22, 2017.

(51) Int. Cl.
*A45D 44/12* (2006.01)

(52) U.S. Cl.
CPC ..... *A45D 44/12* (2013.01)

(58) Field of Classification Search
CPC .. A45D 44/12; A42B 1/00; A42B 1/06; A41D 13/1184
See application file for complete search history.

(56) References Cited

U.S. PATENT DOCUMENTS 704,311 A * 7/1902 Galley ..... A45D 44/12 2/174
4,852,185 A * 8/1989 Olson ..... A61F 9/02 2/9
4,853,974 A * 8/1989 Olim ..... A41D 13/1184 2/9
4,856,535 A 8/1989 Forbes
4,867,178 A * 9/1989 Smith ..... A41D 13/1184 128/858
5,113,528 A * 5/1992 Burke, Jr. ..... A61F 9/02 128/857
5,303,423 A * 4/1994 Gazzara ..... A61F 9/02 128/857
D347,909 S * 6/1994 Gazzara ..... D29/110
5,983,390 A * 11/1999 Desy ..... A41D 13/1161 128/858
9,532,617 B2 * 1/2017 Miller ..... A41D 13/1184
D879,383 S * 3/2020 Bowen ..... D29/110
D882,182 S * 4/2020 Fekete ..... D29/110
2009/0165188 A1 * 7/2009 Nies ..... A45D 44/12 2/174
2012/0047614 A1 * 3/2012 Choi ..... A41D 13/1161 2/9
2012/0167275 A1 * 7/2012 Pugh ..... A45D 44/00 2/174
2012/0222185 A1 9/2012 Erikson

* cited by examiner

*Primary Examiner* — Kristen Matter
(74) *Attorney, Agent, or Firm* — Hall Estill Attorneys at Law; Tyler Mantooth

(57) ABSTRACT

A frameless adjustable facial shield can have a shield connected to a headband with the headband having a gasket strip with multiple protruding ridges configured to continuously contact the skin of a user. The gasket strip can provide a substantially water-tight and releasable seal that separates a face portion of the user from a forehead portion of the user while the face portion is covered by the shield.

19 Claims, 4 Drawing Sheets

FRAMELESS ADJUSTABLE FACIAL AND COSMETIC/MAKEUP SHIELD

CROSS REFERENCE TO RELATED APPLICATION

The present application makes a claim of domestic priority under 35 U.S.C. 119(e) to U.S. Provisional Patent Application No. 62/474,966 filed Mar. 22, 2017, the contents of which are hereby incorporated by reference.

BACKGROUND OF THE INVENTION

Field of the Invention

The present invention relates to a frameless lightweight adjustable reusable protective Face Shield dimensioned to cover and protect the entire facial area of a human wearer. The shield is particularly useful for shielding the facial area against water or shampoo during showering and hair washing, to assure a dry environment of the facial area to maintain previously applied facial makeup, eyelash extensions to remain intact, or protect bandages, incisions, or sutures from recent facial surgical procedures to water thus allowing proper healing.

SUMMARY OF THE INVENTION

A frameless adjustable facial shield, in accordance with various embodiments, has a shield connected to a headband that has a gasket strip with multiple protruding ridges configured to continuously contact the skin of a user. The gasket strip provides a substantially water-tight and releasable seal that separates a face portion of the user from a forehead portion of the user while the face portion is covered by the shield.

BRIEF DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

Figure 1:
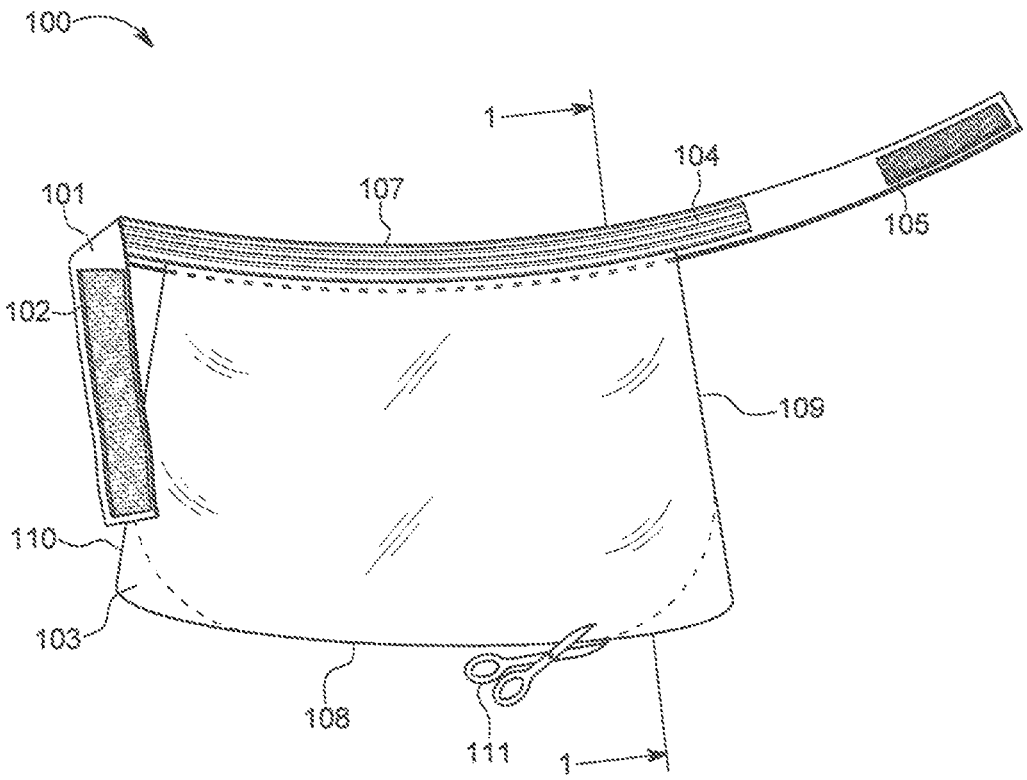
FIG. 1 is a rear perspective relaxed view of a Face Shield constructed in accordance with the preferred embodiment of the invention.

The present invention entitled "Frameless Adjustable Facial & Cosmetic/Makeup Shield", hereinafter referred to as Face Shield 100 is directed to be a transparent, adjustable, light-weight, frameless protective Face Shield 100 to be worn over the face of an individual while showering the body, shampooing or engaging in rinsing out or applying other hair treatment substances, including but not limited to, hair conditioners, aerosol and hair oils, hair dye application and hair chemical treatments for bleaching, straightening and/or curling of the hair. The Face Shield 100 also prevents contaminated water, soap, shampoo, hair conditioners, hair dyes, hair treatment chemicals, hair oils and aerosols and alike from entering the eyes, nose, mouth and facial skin area below the hairline which upon contact could be hazardous, toxic and/or an irritant to the part of the facial area where these substances come into contact. More particularly the Face Shield 100 is designed to provide a watertight seal across the entire forehead and adjacent the hairline along the forehead down towards the temples and ends near the top of the ears on each side of the face enabling the wearer to shower and shampoo the hair without water touching, dripping or spraying the face to protect previously applied cosmetic/makeup applications from being changed, damaged, altered, or washed away from water, soap or shampoo residue during a shower, shampoo, or rinsing out of hair-related chemical, conditioners, dyes, oils and aerosol substances. The Face Shield also prevents contaminated water, soap, shampoo, hair conditioners, hair dyes, hair treatment chemicals (noted above), hair oils and aerosols and alike from entering or touching the eyes, nose, mouth and facial skin area below the hairline from the top of the forehead which upon contact could be hazardous, toxic and/or irritant to the part of the facial area where these substances come into contact. In the preferred form, the Face Shield 100 is constructed in such a manner to be inexpensive, re-usable and convenient to use, put on and remove by using the connecting adjustable headband 101 strap ends to connect or detach to/from each other by hook and loop fasteners, or Velcro™ fasteners 102,105. The Face Shield 100 was intentionally designed with an oversized viewing area of the clear flexible material 103 so the wearer could use as it was originally designed or could easily cut by the wearer the clear flexible material 103 to better fit the shape and comfort of the wearer's face at the discretion of the wearer. Other alternative forms of fastening the headband 101 to the head is use of mechanical snap or clasp fasteners or other means of similar adjustable fastening methods to fasten the Face Shield 100 behind the back of the head at the base of the head near the top of the neck. In this configuration, the hair is mostly not impeded by the headband strap 101 and makes shampooing, conditioning, or rinsing out other hair related substances of the hair surface with both hands a simpler and more thorough activity.

Referring to FIG. 1 the Face Shield 100 is shown comprising a transparent flexible plastic material 103 in a shape adapted to fit conveniently and comfortably around the contour of a patient's face. The Face Shield 100 is shown with a headband 101 made of polypropylene, polyester, nylon, vinyl, cloth, ribbon or other similar materials of approximately 1" in width fastened to the transparent flexible material 103 by a multi-use plastic/rubber/fabric water proof bonding adhesive 106 to the front and top edge of the entire length of the transparent flexible material 103 adjacent to the top of the forehead along the hairline. The shield attaches to the face as shown in FIG. 3 by placing the center of the headband above the top and center of the forehead adjacent to the hairline, and the headband strap 101 is positioned behind the back of each side of the wearer's ears. Not seen in FIG. 2 but seen in FIG. 3, the headband strap 101 are placed over the top of the ears and followed downward behind the ears and continues down the hairline down to the base of the head where both ends of the headband 101 strap ends are connected to each other by Velcro™, hook and loop fastener strip 102, 105, snap fasteners, or similar mechanical fasteners that are adjustable in its purpose to fit various head sizes and various head shapes, to the head to assure a water tight seal and comfort of the wearer. To accomplish these objectives, fastener means and preferably includes 0.75"-1.0" inches wide Velcro™ or hook and loop strips 102, 105 respectively, to obtain an adjustable connection for the headband to fit securely to the head. Other widths and lengths of hook and loop fasteners may be used as well. The hook and loop strips can vary from 1.0" to 7.0" inches in length and in the preferred form can be adhered to at each end of the headband strap 101 by a specialty multi-purpose plastic/rubber waterproof bonding adhesive 106 or also be attached by sewing the hook and loop or Velcro™ strips 102, 105 to the headband 101. Other forms of fastening the hook and loop strap 102, 105 alternatively use of a mechanical fastening device such as a micro/small plastic snap tack fastener, plastic snap rivet fastener or similar mechanical fasteners.

These fastening methods of attaching the hook and loop strips 102, 105 to the headband may be used to adhere the hook and loop strip in combination with a waterproof multi-purpose bonding adhesive 106, sewing, and/or mechanical plastic snap or tack rivet fastener or similar mechanical fastening device.

The operation of strips 102, 105 depends on the engagement between many woven monofilament hooks on strip 102 with woven loop filaments on the opposite strip 105. Strips 102, 105 are durable and can be attached and detached many thousands of times. All that is necessary to separate strips 102,105 is to peel one strip from the other. Strips 102, 105 provide an adjustable self-locking action so that it can snugly fit around the wearer's head. The mating loop strips 105 are fastened or sewn to the lateral positions 102 on headband 101. The loop strips 105 on headband 101 become detachably fastened to the hook strips 102 on the headband 101 in whatever position they are pressed together.

Figure 2:
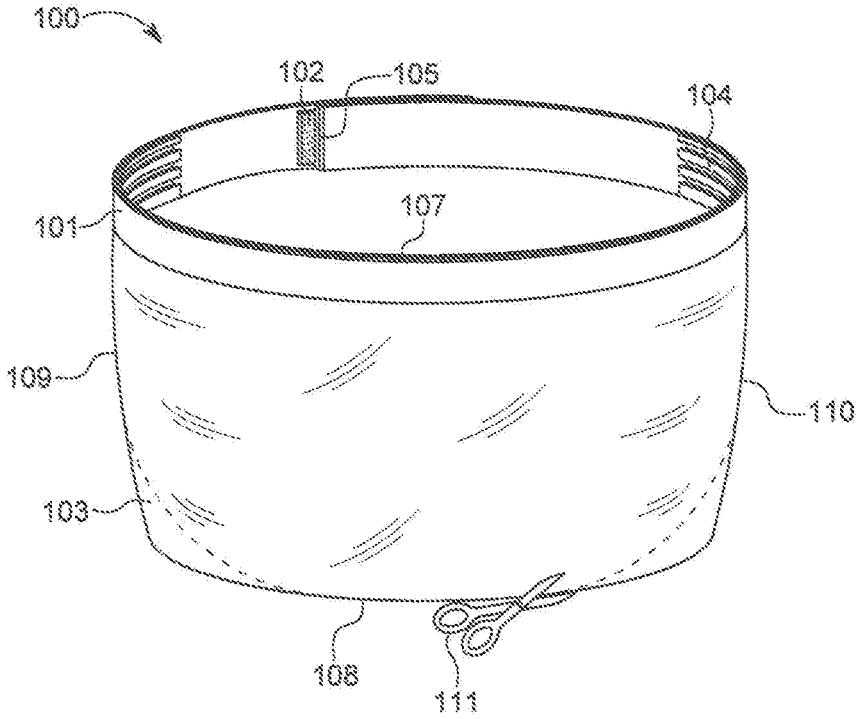
FIG. 2 is a front perspective view of a Face Shield as would appear fastened constructed in accordance with the preferred embodiment of the invention.
Figure 3:
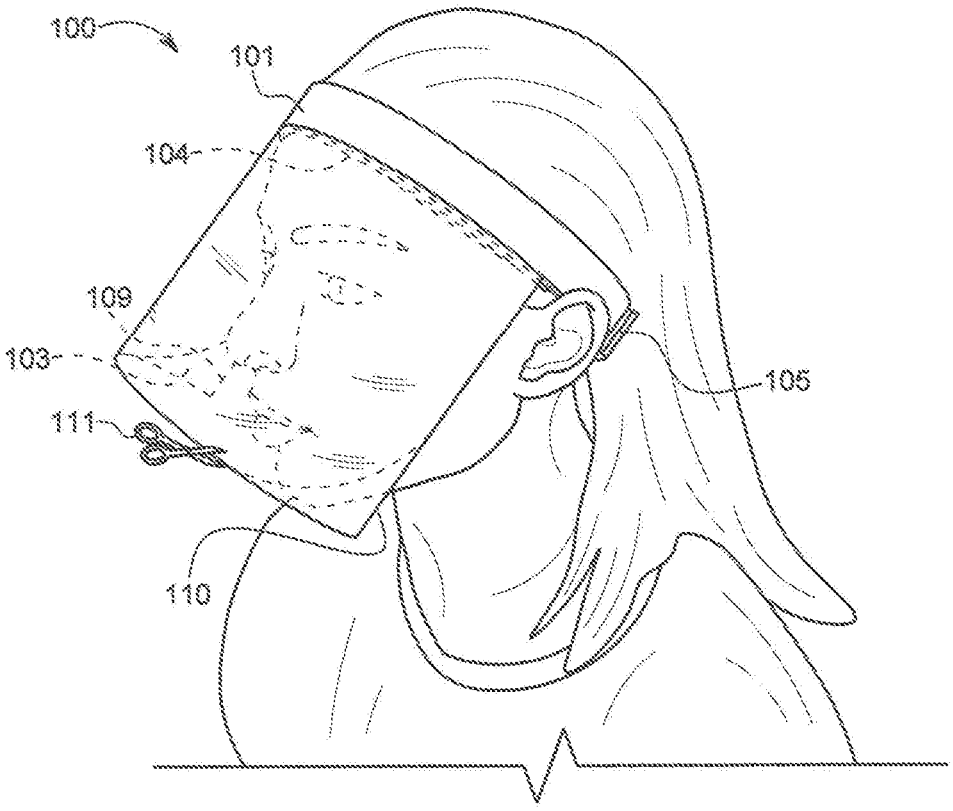
FIG. 3 is a perspective view of the Face Shield during use as seen from the left front side of the wearer.
Figure 4:
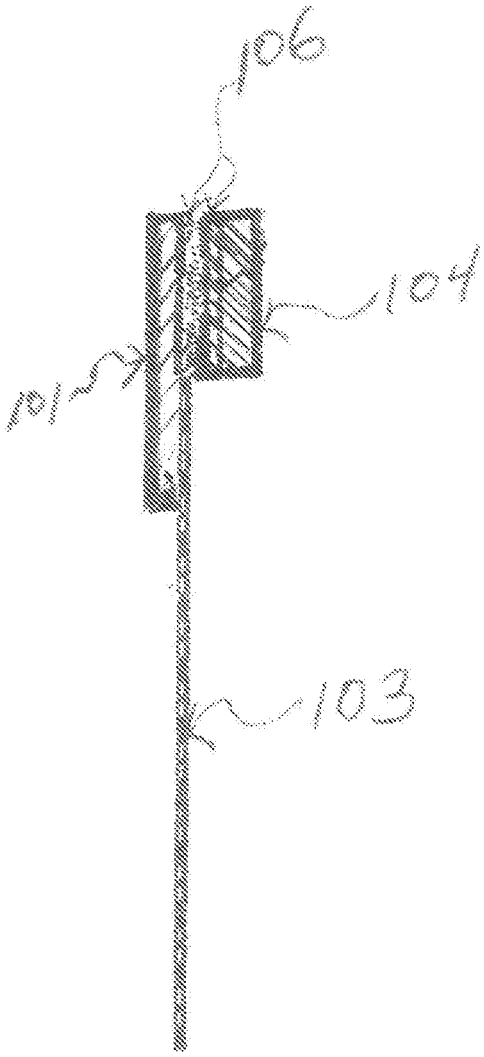
FIG. 4 is a cross sectional view of the Face Shield as seen along line 1-1 of FIG. 1.

The Face Shield 100 as seen in FIGS. 2 & 3 is in the fastened contoured configuration as if it were being worn by the wearer. In the preferred form of the invention the Face Shield 100 is formed from flat clear sheet material 103 which is cut into the desired shape and size using conventional dies and/or cutting techniques. Alternatively, the Face Shield 100 can be pre-formed having a slight convex shape to the shield to maintain the shield in a spaced outward and downward angular relationship from the top of the forehead to the bottom of the face at/or below the chin of the wearer.

As can be seen in FIGS. 1 and 2, the Face Shield 100 according to the preferred embodiment of the invention includes a viewing portion with an essentially rectangular shape. The Face Shield 100 has a horizontal upper edge 107 and a parallel bottom edge 108. The rectangular shape of the Face Shield 100 forms opposite sides comprising right side edge 109, and a left side edge 110. Although the preferred form of the Face Shield is rectangular, there are many other design shapes of the clear flexible material that would be alternatively effective. The invention was purposefully designed with an oversize large facial viewing coverage area so the wearer could wear the Face Shield 100 in its original rectangular shape or at the discretion of the wearer could easily be cut or trimmed by scissors 111 or similar cutting device to customize the viewing. In the preferred form of the invention the Face Shield 100 is formed of a light weight clear flexible sheet material 103 which can be easily cut and formed with scissors 111 or similar cutting tool. It is desirable that in addition to being flexible the sheet material should be sufficiently rigid to be self-supporting such that when conformed to the contour of the face the clear plastic material 103 will take on a semi-cylindrical shape without collapsing as best shown in FIG. 2. It has been found that the Face Shield can be formed from any thin clear flexible sheet material ranging in thickness between 0.005"-0.040" inches.

Although any clear flexible sheet material can be used the preferred materials include the polypropylenes, acrylates, styrene, polyvinylchlorides, polyamides, polyolefins, vinyl, fluorocarbons, polycarbonates, Mylar™, or cellulose acetates film. The thickness of the sheet material will depend on the material used to ensure sufficient flexibility without sacrificing the need of the material to be self-supporting. The material selected is generally inexpensive such that the shield can be manufactured at a relatively low cost and is reusable. In the preferred embodiment of the invention, the body is formed from polycarbonates, acetates, or polyethylene terephthalate ("PETG"), with a preferred thickness of 0.01" inches.

Referring to FIG. 2 the Face Shield 103 is provided with a flexible rubber gasket strip 104 or similar rubber-like water resistant materials that provides for a watertight seal against the skin of the face at the top of the forehead and adjacent to the hairline, the dimensions of the rubber gasket strip is 0.1875" to 1.0" inches in width and 14.0" to 16.0" inches in length and 0.0625" to 0.5" inches in thickness. The shape of the rubber strip can take on various forms but will not change the nature of the waterproof properties or the effectiveness of the invention. In the preferred form, this rubber gasket strip 104 is fastened by an easily available specialty multi-purpose, plastic/rubber/fabric, waterproof bonding adhesives 106. Alternative forms of fastening the rubber gasket strip gasket 104, to clear plastic material 103 include plastic snap or tack rivets, or similar fastener mechanical devices can also be used in combination or separately with the bonding adhesive 106 to fasten the rubber gasket strip 104 to the clear plastic material 103 the entire length of the top edge 107 of the clear flexible material 103 of the Face Shield 100. In FIG. 2, the rubber gasket strip 104 attaches parallel to the top edge the upper edge 107 of the clear flexible material 103 and the portion of the rubber gasket strip 104 that extends beyond the length of the clear flexible material 103 is fastened to the polypropylene, nylon, vinyl, ribbon, cotton or other cloth to the headband strap 101 webbing at the top edge of the headband strap 101 webbing on each side of the Face Shield 100 by a specialty multi-purpose plastic/rubber/fabric waterproof bonding adhesive 106 and/or plastic snap or tack rivets, or similar fastener mechanical devices can also be used in combination or separately with the same bonding adhesive 106. By providing for a 0.1875"-1.0" inch rubber gasket strip 104 beyond each side of the clear flexible material 103 at the upper edge 107 of the Face Shield 100 allows water, soap, or shampoo, hair treatment related chemicals, oils, dyes aerosol residue from showering, shampooing or rinsing of other treatment substances of the hair to run around the ends of the rubber gasket strip 104 on both sides and away from the face so water, soap, shampoo, conditioners and other hair related treatment substance residue is deflected not only by the clear flexible material 103 of the Face Shield 100 but around the rubber gasket strip 104 at the upper edge 107 of the Face Shield 100 beyond the periphery of the entire facial area and deflected away from the entire facial area toward the ears well away from the face. Thus, protecting previously applied cosmetics/makeup from being degraded, altered, damaged, or washed away from showering, shampooing, rinsing out of other hair-related substances and prevents contaminated water, soap, shampoo, hair dyes, hair treatment chemicals, hair oils and aerosols and alike from entering the eyes, nose, mouth and facial skin area below the hairline which upon contact could be hazardous, toxic and/or an irritant to the part of the facial area where these substances come into contact. The rubber gasket strip 104 fastens to the entire upper edge 107 of the Face Shield 100 in the preferred form of the invention extends along the upper edge 107 and continues outwardly the full length of the upper edge 107 of the Face Shield 100. Depending on the intended use and the final desired shape when applied to the face the actual areas provided with the rubber gasket strip 104 may be varied in length, width and thickness, and may vary as to relocating the adhesion of rubber gasket strip 104 on clear plastic material 103 of the Face Shield 100. In the preferred form the inside part of the rubber gasket strip 104 that contacts the skin has multiple multi-level protruding ridged edges molded into the rubber gasket strip 104 that when contacts with the facial skin of the wearer, the edges form a water tight seal along the entire length of the rubber gasket strip 104 touches facial skin of wearer when the Face Shield is worn correctly. Various strip shapes that may be used for the waterproof sealing of the upper edge of the mask may take various other forms without changing the embodiment of the invention. Such variations can be a solid or hollow core and may range in various colors and shapes most commonly rectangular, triangular, square, "D"-shaped, "P"-Shaped, half circle, or multiple cords within the strip. The various shapes can be relatively flat in depth or can protrude outward up to 1.0 inches adhered to each other between the mask and the skin. Other alternative forms of the part of the rubber gasket strip 104 that touches the skin and adjacent the hairline, could be rounded, flat, ridged and have multiple thin rows within a strip configuration that essentially provides for a watertight seal around the upper edge 107 of the Face Shield 100 in the same purpose as the preferred form described herein.

The same bonding adhesives 106 referenced herein used in adhering the headband strap 101 webbing, and the rubber gasket strip 104 to the clear flexible material 103 may be a specialty multi-purpose, plastic/rubber/cloth, waterproof bonding adhesives 106 available such as a silicone based resin, epoxies, cyanoacrylates and/or, or in combination with the bonding adhesive fastened together by plastic snap rivet, plastic tack rivet or similar mechanical fastening device.

Referring to FIG. 3, the Face Shield 100 according to the invention is shown in use as worn properly by the wearer. To put on the Face Shield in the preferred form, your face should be looking straight up so the Face Shield 100 will sit on the face without requiring the wearer's hands to keep the Face Shield in place. While still looking upward and maintaining wearer's head in the same upward position so the back of the head is approximately parallel to the floor, place the back-facing side of the Face Shield with the midpoint of the rubber gasket strip 104 of the Face Shield 100 against the wearer's skin at the middle and top of the forehead adjacent to the hairline. In this configuration, the headband strap 101 side of the Face Shield 100 will be facing outwardly from the face. While continuing to look upwards in same position use each hand to take the end of each headband strap 101 and place each headband strap behind the top of each ear so the bottom width of the headband strap 101 is comfortably on or slightly above the ear behind the top part of the ear. Thereafter, with each hand continuing to hold each end of the headband strap 101, place the headband strap 101 around the back of the ear and adjacent to the hairline and at the bottom and center of the back of the head just below the hairline connect the headband straps 101 by using the adjustable hook and loop fasteners 102, 105 Velcro™ fasteners, or similar adjustable fastening devices. As referred to in FIG. 3, if the Face Shield 100 is properly placed as described herein the top edge 107 of the Face Shield 100 should fit securely along the top of the forehead and the headband 101 should fit snug and securely on the head with the headband strap slightly touching the top of the ear at its base where the ear is connected to the head and the ends of the headband strap 101 connected to each other at the base of the head just below the hairline fastened by hook and loop fasteners 102, 105 or Velcro™ and/or other mechanical plastic fastening devices not above. As can also be seen in FIG. 3, when worn correctly the Face Shield will protrude in an outwardly angle from the top edge 107 of the Face Shield 100 protruding outward so the bottom edge 108 of the Face Shield 100 is approximately 2.0" to 5.0" inches away from the bottom of the face. This outward angular positioning of the Face Shield 100 causes the water, soap shampoo residue from showering, shampooing or rinsing of hair related treatments requiring the use of chemicals, oils, dyes, bleaches and aerosols to deflect away from the face avoiding any of the previously described substances from reaching or touching any of the area of the face or preventing water, soap, shampoo, hair related chemical, oil, dye or hair aerosols residue from dripping, leaking or seeping through the rubber gasket strip 104 onto the face which could be hazardous, toxic, and/or an irritant to the facial areas where these substances come into contact.

As can be seen in FIG. 2 the flexibility of the viewing portion of the Face Shield 100 produces a semi-cylindrical structure leading away from the forehead outwardly and downwardly over the nose and extending further outwardly at the level of the chin of the wearer. In the preferred form the Face Shield 100 is of sufficient dimensions to permit the shield to be significantly spaced from the face to produce a substantial deflection of water, soap shampoo, hair treatment substances (described above) residue away from the face of the wearer. The rubber gasket strip 104, at the top edge 107 of the Face Shield 100 which is fastened to the clear plastic material 103 of the Face Shield 100 is the only material of the Face Shield 100 that contacts the wearer's facial skin. No other part of the viewing area or any other component of the Face Shield touches the facial skin area. This preferred embodiment is essential to the invention as any other touching of any other area of the facial skin by bonding adhesives, bonding adhesive tapes, rubber, plastic, other material, or by any clear flexible material could damage, change, alter, degrade the facial makeup/cosmetics applied prior to showering or shampooing. Similarly, in an alternative form the Face Shield 100 can be pre-formed to have a slightly convex shape to maintain a space between the shield and the facial skin area itself.

The Face Shield 100 constructed according to the invention is simple and inexpensive to manufacture and can be produced at a cost whereby the Face Shield 100 is reusable. The Face Shield 100 is easy to apply and to remove and enables the wearer to conveniently shower and shampoo regularly without having to reapply time consuming makeup/cosmetic application applied prior to showering or shampooing the hair. The Face Shield 100 also prevents contaminated water, soap, shampoo, hair dyes, hair treatment chemicals, hair oils and aerosols and alike from entering the eyes, nose, mouth and facial skin area below the hairline at the top of the forehead which upon contact could be hazardous and/or irritant to the part of the facial area where these substances come into contact as well degrading, altering, washing away previously applied cosmetic/makeup applications.

As shown in FIG. 3 the Face Shield 100 when constructed and attached to the head according to the invention, enables the wearer to move the head freely in the shower without risk of exposing the facial areas to water, soap or shampoo residue and allowing the wearers hands to be free to shower and shampoo without requiring the need to hold the mask in place either with one hand or both hands. The size of the clear plastic material 103 in the preferred form is sufficient to extend from the forehead downward past the chin. In its preferred form the Face Shield 100 may be manufactured in primarily a one-size-fits all configuration and the clear flexible plastic material 103 can easily be cut and trimmed at the wearer's discretion, however, various sizes of the Face Shield 100 and can be manufactured to fit irregular size head shapes of the wearers head and irregular size areas of the face intended to be protected.

The Face Shield 100 of the invention is relatively light weight and can be packaged in any desired configuration due to the flexibility of the material. The preferred form of packaging however is each Face Shield 100 individually rolled-up vertically and placed individually in a box that is configured in size and dimension to contain 1 Face Shield within each box. However, alternative forms of packaging of the product may be used as well.

Although the preferred embodiment of the invention envisions using the Face Shield 100 during showering, shampooing, rinsing or applying hair related substances the shield can be worn in any environment where the facial makeup/cosmetics may be subjected to risk of precipitation from natural weather elements, such as rain, snow, drizzle and other forms of precipitation thus risking damage, altering, degrading, changing or washing away of facial makeup/cosmetics. The Face Shield 100 can further be used by wearer's and hair styling professionals during other various hair treatments not described herein from entering the eyes, nose, mouth and facial skin area below the hairline which upon contact could be hazardous, toxic and/or an irritant to the part of the facial area where these substances come into contact and/or damage, alter, change, degrade, or wash away facial cosmetic/makeup.

The foregoing detailed description of the invention is provided primarily for purposes of illustrating the preferred embodiment of the invention. It will be recognized by those skilled in the art that the preferred embodiment is not intended to be limited to the particular structure and method of operation as they may be readily modified. It will be further readily apparent to those skilled in the art that numerous other modifications not mentioned herein can still be made without departing from the spirit and scope of the invention.

The invention claimed is:

1. A face shield comprising a shield connected to a headband, the headband comprising a gasket strip with multiple protruding ridges arranged in multiple thin rows extending along, and parallel to, a longitudinal axis of the headband, the multiple protruding ridges configured to continuously contact a skin of a user and provide a substantially water-tight and releasable seal separating a face portion of the user from a forehead portion of the user while the face portion is covered by the shield.

2. The face shield of claim 1 wherein the shield comprises a transparent material of at least 0.005 inches to no more than 0.040 inches in thickness.

3. The face shield of claim 2, wherein the transparent material is plastic.

4. The face shield of claim 1 wherein the shield is shaped to continuously cover the face portion of the user with the shield attached to the headband proximal the forehead portion of user and unattached proximal a chin region of the face portion.

5. The face shield of claim 1 wherein the headband continuously extends around, and conforms to, a shape of a head of the user.

6. The face shield of claim 1 wherein the headband comprises a water absorbent or water repelling material.

7. The face shield of claim 1 wherein the headband comprises a first fastener on a first end of a strap and a second fastener on a second end of the strap, the first fastener to selectively form a physical connection with the second fastener.

8. The face shield of claim 7 wherein the first fastener and second fastener attach via a hook-and-loop mechanical interaction.

9. The face shield of claim 1 wherein the headband has a length of at least 23 and no more than 30 inches.

10. The face shield of claim 1 wherein the gasket strip comprises a pliable water repelling material with a width of at least 0.1875 inches to no more than 1.0 inches, a length of at least 14.0 inches to no more than 16.0 inches, and a thickness of at least 0.0625 inches to no more than 0.5 inches.

11. The face shield of claim 1 wherein the gasket strip is attached to the shield via a waterproof adhesive that dries in a non-liquid form.

12. The face shield of claim 1 wherein the shield is attached only to the headband with opposite sides of the shield separated from sides of the face portion proximal to a respective ear of the user.

13. The face shield of claim 1 wherein the gasket strip forms a watertight seal along an entire perimeter of the forehead portion along a hairline.

14. The face shield of claim 1, wherein the shield comprises a single piece of transparent material supported only by the headband.

15. The face shield of claim 1 wherein the headband extends around a head of the user while exposing a first ear and a second ear of the user.

16. The face shield of claim 1, wherein the multiple protruding ridges extend from the gasket strip toward the skin with multiple different levels.

17. The face shield of claim 1, wherein the gasket strip has a rounded shape protruding towards the skin.

18. The face shield of claim 1, wherein the gasket strip has a triangular shape protruding towards the skin.

19. The face shield of claim 1, wherein the face portion is only sealed from a top side proximal the forehead portion with side and bottom sides of the face portion open to air.

* * * * *